United States Patent [19]

Maczuszenko et al.

[11] Patent Number: 4,692,017

[45] Date of Patent: Sep. 8, 1987

[54] TONER TRANSFER APPARATUS

[75] Inventors: Andrzej Maczuszenko, Etobicoke; Sotos M. Theodoulou, Bramalea, both of Canada; John Rumsey, Charlestown, Mass.

[73] Assignee: Delphax Systems, Mississauga, Canada

[21] Appl. No.: 812,027

[22] Filed: Dec. 23, 1985

[30] Foreign Application Priority Data

Dec. 24, 1984 [CA] Canada ..... 470985

[51] Int. Cl.[4] ..... G03G 15/08

[52] U.S. Cl. ..... 355/3 DD; 355/14 D; 355/3 R; 355/15; 430/122; 118/657; 118/658; 118/639

[58] Field of Search ..... 355/3 DD, 14 D, 3 R, 355/14 R, 15; 55/397, 154, 394; 118/657, 658, 639; 430/122

[56] References Cited

U.S. PATENT DOCUMENTS

| | | | |
|---|---|---|---|
| 3,909,864 | 10/1975 | Tanaka et al. | 355/15 X |
| 4,361,396 | 11/1982 | Uchida | 355/15 |
| 4,583,112 | 4/1986 | Morano et al. | 355/15 X |
| 4,595,277 | 6/1986 | Maczuszenko et al. | 355/14 D |

OTHER PUBLICATIONS

Jugle, "Controlling Airborne Particle Emission", *Xerox Disclosure Journal,* vol. 2, No. 2, Mar./Apr. 1977.

Jugle et al, "Improved Filter Apparatus", *Xerox Disclosure Journal,* vol. 2, No. 2 Mar./Apr., 1977.

Jugle et al, "Improved Emission Controller . . . ,"*Xerox Disclosure Journal,* vol. 2, No. 2, Mar./Apr., 1977.

*Primary Examiner*—A. C. Prescott

*Attorney, Agent, or Firm*—Rogers & Scott

[57] ABSTRACT

A toner system for delivering powder toner from a storage hopper to an element carrying an electrostatic pattern of charge to be toned before transfer to a receptor such as paper includes a scavenger which, when coupled to the toner system can be actuated to develop a slight negative pressure in the toner system sufficient to entrap flow enhancers such as zinc stearate and to remove the non-magnetic zinc stearate from the toner system. The scavenger includes baffles for collecting particles and means for developing the negative pressure in the toner system.

The toner system also includes a pair of magnetic clips for positioning on the metering blade of the toner system to define the width of the toner path being transfered from the toner system to the electrostatic image on the dielectric surface and a cleaning device which periodically moves along the metering blade to clean the front of the metering blade of any accumulated toner.

10 Claims, 4 Drawing Figures

TONER TRANSFER APPARATUS

This invention relates to toner systems for use in delivering powder toner from a storage hopper to an element carrying an electrostatic pattern of charge to be toned before transfer to a receptor such as paper. More particularly, the invention relates to the removal of material mixed with the toner to improve flow and to minimize the build up of such material in the system and also to provide structure for improving the performance of such systems.

Powder toner is transported from a storage area to the point of use in copiers or printers in one of two distinct ways. In one system, the toner is elevated from a trough or other storage device and any excess toner is allowed to fall back into the trough. In the second type of system, powder toner is supplied under gravity from an opening at the bottom of a hopper and transported from this opening to the point of use. The present invention is of the latter type for use with toner suitable for cold pressure fusing and consisting of particles of iron oxide coated in toner and commonly refered to as "single component toner". Such toner also includes a component (to be referred to as "flow enhancer") to improve flow. A typical flow enhancer is particulate zinc stearate.

Single component toner particles, by their very nature, tend to agglomerate under pressure so that there is a tendency at the bottom of the hopper for the particles to attach to one another to form lumps and to bridge across the bottom opening despite the presence of the zinc stearate. Such conditions detract from the efficient flow of toner and have in fact influenced development work away from cold pressure fusing because of the difficulties inherent in handling this type of toner. The conditions are aggravated by the need to store a significant supply of toner if the associated machine is to operate for a reasonable period of time between servicing because the toner settles in the hopper thereby removing the air which is essential for smooth flow of the toner.

The desired rate of flow of toner cannot be predetermined because it is used to tone a series of electrostatic patterns which have varying demands for toner. This has led designers to approach the problem by ensuring that excess toner is available at all times and this of course leads to the problems of lumping and bridging already mentioned.

In an improved structure, toner is retained in a hopper remote from the point of use until released on demand. At all times between the hopper and the point of use, the static load in the toner is minimized and the particles of toner are kept in motion by a magnetic field which control not only the flow to the point of use but also recirculation of toner which is again delivered to the point of use. The present invention is an improvement over this type of structure and an object of the invention is to maximize the advantages of such a structure by providing a scavenger to remove a significant percentage of zinc stearate found in the toner to prevent build up of zinc stearate and to minimise the migration of the zinc stearate into other parts of the printer or copier.

It is another object of the invention to provide means for controlling the width of the toner path reaching the printer drum.

A third object is to minimise build up of toner at the blade which meters the thickness of toner permitted to pass toward the drum thereby limiting the risk of excess toner appearing for transfer to the drum.

In one of its aspects the invention provides a scavenger which, when coupled to the toner system can be actuated to develop a slight negative pressure in the toner system sufficient to entrap flow enhancers such as zinc stearate and to remove the non-magnetic zinc stearate from the toner system. The scavenger includes baffles for collecting particles and means for developing the negative pressure in the toner system.

In another of its aspects the invention provides a pair of magnetic clips for positioning on the metering blade of a toner system to define the width of the toner path being transfered from the toner system to an electrostatic image on the dielectric surface.

In yet another document aspect of the invention, a cleaning device is provided which periodically moves along the metering blade cleaning the front of the metering blade by contact with particulate toner which may have accumulated on the metering blade.

These and other aspects of the invention will be better understood with reference to the following description taken in combination with the drawings in which.

Figure 1:
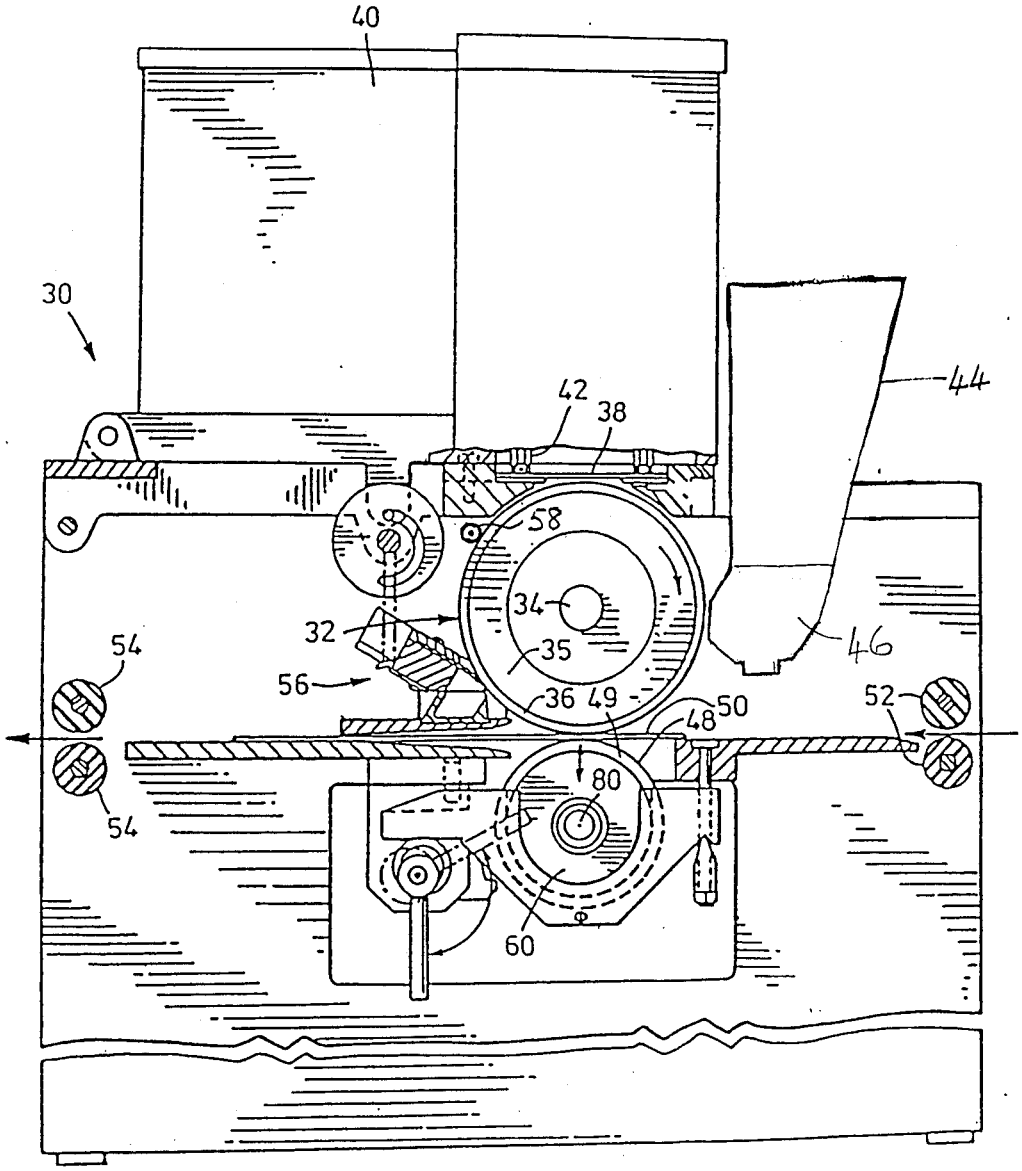
FIG. 1 is a diagrammatic side view, partially in section of a exemplary electostatic printer using a toner system according to a preferred embodiment of the invention and shown in outline in this view.

Reference is made firstly to FIG. 1 which shows somewhat schematically an exemplary electrostatic printer 30 incorporating the preferred embodiment of the toner system according to the invention. This printer is illustrated primarily to demonstrate a suitable environment for the invention. Other printers and also photocopiers using photo receptors could also benefit from use of the invention.

As seen in FIG. 1 a cylinder 32 is mounted for rotation about an axis 34 and has an electrically conductive core 35 coated in a dielectic layer 36 capable of receiving an electostatic image from a cartridge 38. This cartridge is driven by an electronic control system 40 and connected by mechanical connectors 42. As the cylinder rotates in the direction shown, an electostatic image is formed by the cartridge 38 on the outer surface of the dielectric layer 36. This image passes the toner system where toner is delivered from hopper 44 by a feeder mechanism 46 and applied to the electrostatic image. The resulting toned image is carried by the cylinder 32 towards the nip formed with a pressure roller 48 which has a compliant outer layer 49 positioned in a path of a receptor such as paper 50. A pair of feed rollers 52 drive the paper 50 towards the nip where the cylinder 32 and roller 48 combine to move the paper towards a pair of output rollers 54. The pressure in the nip is sufficient to cause the toner to transfer to the receptor 50 and, with sufficient pressure, the toner will also be fused to the receptor.

After passing through the nip between the cylinder 32 and the roller 48, any toner remaining on the surface of the dielectric layer 36 is romoved by a scraper blade assembly 56, and any residual electostatic charge remaining on the surface is then neutralized by a discharge head 58 positioned between the scraper assembly 56 and the cartridge 38.

It is desirable to control the flow of toner axially on the drum so that it is distributed evenly along the length of the drum. It is not uncommon for end effects to change the magnetic relationship existing at the ends of the toner path and this invention provides a structure to minimise such effects. Also, the amount of toner allowed to pass towards the drum is controlled by a metering blade and clearly such a blade has to have no build up on it otherwise the amount of toner passing the blade will vary and be uneven. Structure is provided to keep this blade clean. Thirdly, because of the necessity to include a material which enhances the flow characteristics of the toner particles, zinc stearate is provided in the toner and this has no magnetic properties. Consequently it tends to separate from the mixture and build up influenced by electrostatic charges. In extreme cases it finds its way out of the toner assembly into other parts of the printer or copier. The invention provides a system to remove this flow enhancer selectively from the toner.

The structures to achieve these results will be described with reference to the subsequent drawings.

Figure 2:
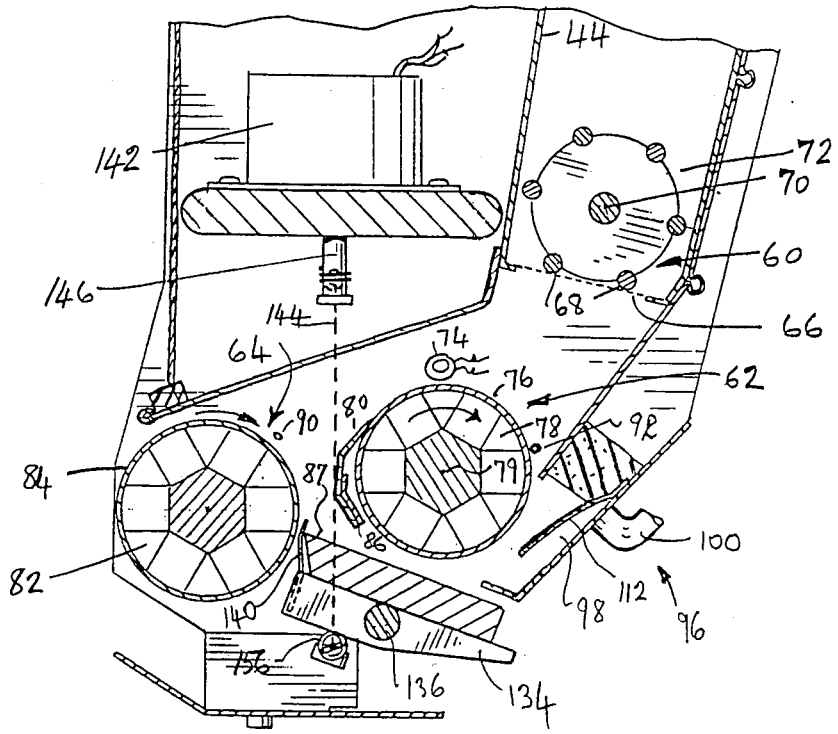
FIG. 2 is a sectional end view of the toner system to a larger scale than that used in FIG. 1.

Reference is now made to FIG. 2 which illustrates the toner system 46 in greater detail and to a larger scale than that used in FIG. 1. Toner stored in the hopper 44 falls onto an agitator 60 which is controlled to meter toner as required by a feeder 62 forming, with the agitator, a supply device. As will be described, the feeder 62 transports toner to an applicator 64 which in turn carries the toner to the surface of the dielectric layer 36 of the cylinder 32.

It has been found that one of the major difficulties of feeding toner is its tendency to build up into large masses which tend to hold the remaining toner in position in the hopper and prevent free-flow towards the cylinder 32. This structure overcomes this disadvantage even with toners which are particularly prone to this problem. The agitator consists of two major parts. Firstly, a screen 66 of stainless steel having 60 openings per inch and 37 percent open area is supported at its ends and the screen is deflected by contact with rods 68 which are spaced equally from an axis of rotation 70 of an agitator element 72. As this element rotates, the rods come into contact with the screen causing a sweeping action over the screen which breaks down bridges of toner existing over openings in the screen thereby sifting toner through the screen towards the feeder 62. This action is operated periodically as will be described. As soon as the element 72 stops, toner tends to bridge over the openings in the screen thereby supporting the toner in the hopper and preventing the weight of settled toner being applied to the feeder 62. Consequently, the feeder operates only in toner which is allowed to fall as a result of the operation of the agitator.

The amount of toner available to the feeder 62 is controlled by a sensor 74 and associated control circuit. The feeder consists of a cylindrical outer shell 76 supported on bearings for rotation independently of a magnetic core 78 made up of a series of magnets arranged equally about an axis of rotation 79. These magnets are also rotatable about this axis driven independently of the shell. In the preferred embodiment, when toner is being fed and the agitator is stationary, the core rotates at a speed in the range 450 to 500 rpm and the shell moves in the same direction as that shown for the magnets in FIG. 2 at a slow speed of about 4 rpm.

Because of the rotation of the magnets in a clockwise direction (as drawn in FIG. 2), the mass of toner tends to move around the shell in an anti-clockwise direction meeting a scraper blade 80 set in position to cause the toner carried to this point to slide over the blade towards the applicator 64. The transfer of toner from the feeder to the applicator is essentially a transfer from one magnetic influence to another. Because the magnets in the feeder are moving at quite a high angular velocity, they set up an oscillating field on the blade 80 and the toner tends to "dance" along this blade. The applicator consists of a similar mechanical structure having a stationary core 82 of magnets and a shell 84. The core 82 can be adjusted angularly as will be described to set up a stationary magnetic field into which the toner is drawn as it passes along the scraper blade 80 of the feeder.

In order to help control the magnetic field and enhance the flow of toner from the feeder 62 to the applicator 64, a magnetic shield 86 is located under the scraper blade 80 and adjacent the feeder 62 so that the magnetic field between the feeder and the applicator 64 is modified in the area covered by the shield. There will of course be a field below the shield and as already explained, above the shield where the toner moves down the scraper blade 80. The applicator is positioned adjacent the cylinder 32 and at its other side, a metering blade 87 controls the depth of toner on the applicator until it meets the cylinder 32 (FIG.1) carried by the shell 84 which moves at a speed preferably in the range 250 to 350 rpm. The result is a pool of toner available for transfer to the cylinder as the surface of the cylinder passes the applicator. Any toner which is carried by the applicator 64 upwardly from the pool and back into the enclosure meets a toner discharge wire 90 which both agitates the toner and discharges any build-up of charge in the toner. It is necessary to have some excess of toner on the applicator as the toner approaches the metering blade 87 in order to ensure an adequate supply at the cylinder 32 where the pattern of charge to be toned will vary between a very sparse image to a very dense one requiring more toner.

Excess toner stripped by the blade 87 falls into the bottom of the enclosure, where it comes under the influence of the magnetic field set up by the core 78 of the feeder 62 below the shield 86. The toner is then carried in an anti-clockwise direction back around the feeder and meets a second discharge wire 92 to help break up possible lumps of toner which may have developed and to discharge the toner. The recirculated toner continues in the magnetic field meeting new toner supplied from the hopper 44.

The sensor 74 is an elongate member carrying a series of electrical contacts connected to a control circuit. Normally, the contacts are immersed in toner travelling about the feeder 62 so that there is electrical continuity between pairs of the contacts. Should one or more contacts be exposed outside the toner, the loss of electrical continuity is sensed and the control circuit activates the agitator element 72. The control circuit is adjusted to maintain this movement until there is again no demand for toner. There is also an alarm built into the circuit to indicate that a demand for toner is not being met within a predetermined time.

As described previously, toner passes over the scraper blade 80 and falls into the influence of the magnets forming the core 82 of the applicator 64 and is carried around past the blade 87 by the shell 84. Once toner reaches the surface of the cylinder 32, a pool of toner builds up between the applicator and the cylinder and the location and extent of this pool is dependent upon the angular position of the core 82. Preferred positions will be described. Excess toner then travels back to be used again.

Figure 3:
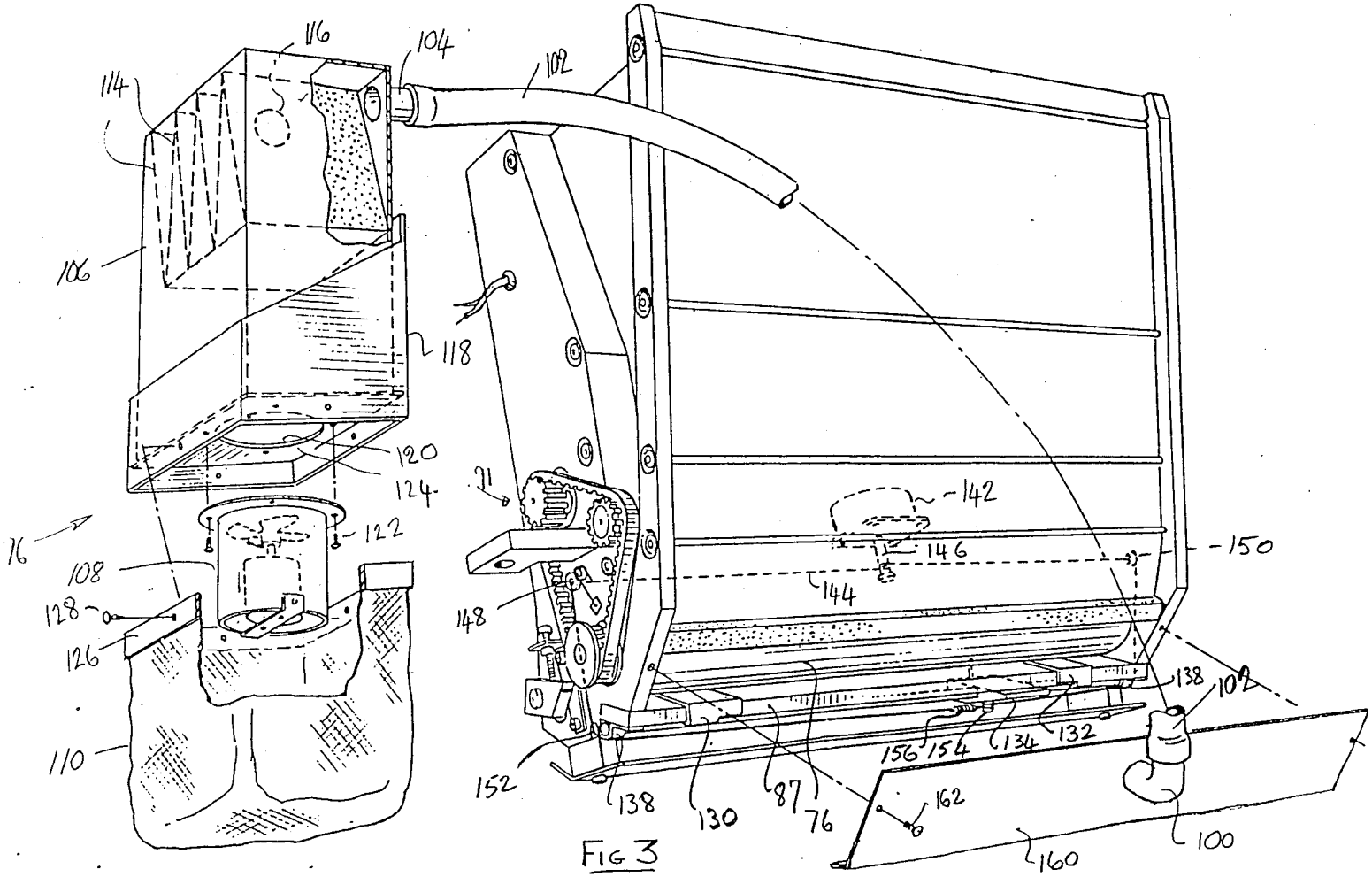
FIG. 3 is prespective and partly exploded view looking from the rear and one end of the toner system.
Figure 4:
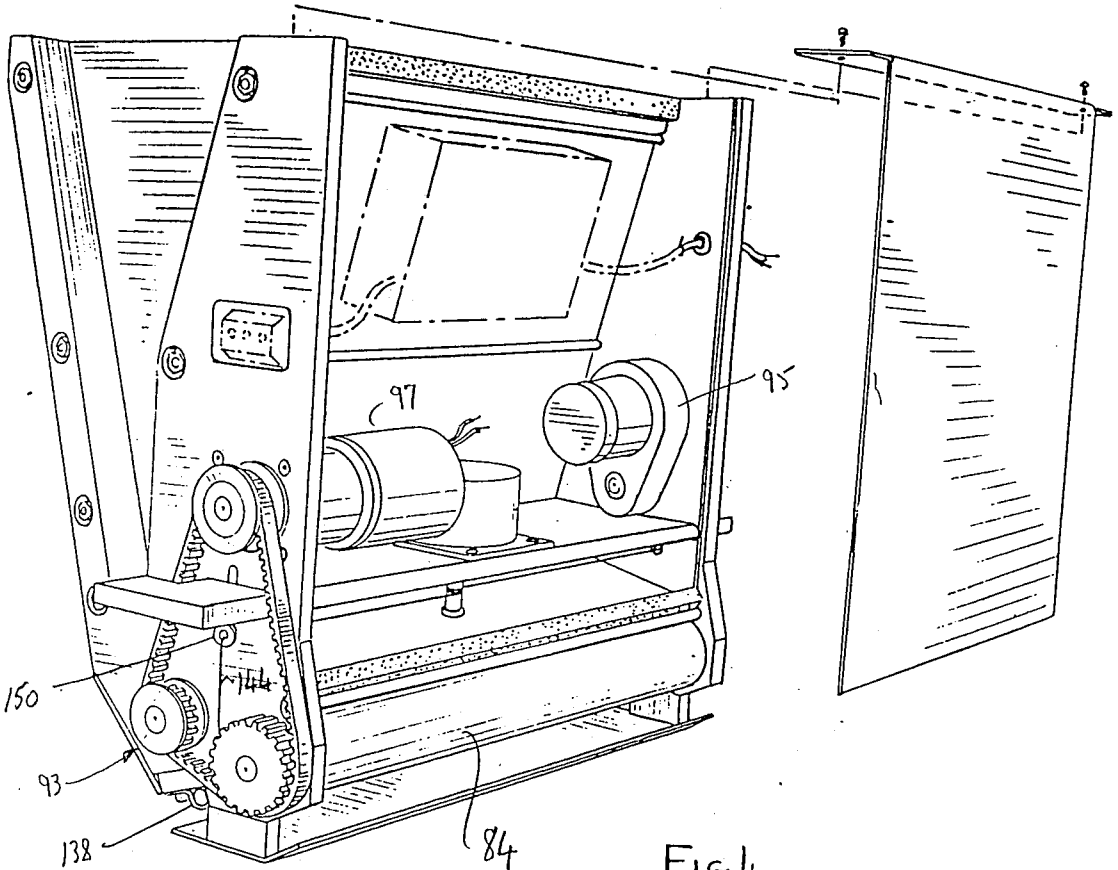
FIG. 4 is a view similar to FIG. 3 looking from the front and the other end of the toner system.

As seen in FIGS. 3 and 4 there are two drive chains 91,93 driven by respective motors 95,97. These drives are concentrical in structure. The motor 95 drives through drive chain 91, the shell 76 and agitator 60. However when the shell 76 is moving in a clockwise direction as shown in FIG. 2, the agitator is stationary because it is connected by a one-way clutch. When toner is needed, motor 95 is reversed to drive both the shell 76 and the agitator. Motor 97 and drive chain 93 rotate the shell 84 and core 78.

The foregoing structure is exemplary of toner systems which can make use of the improvements according to the present invention. Reference is now made to FIGS. 2 and 3 to describe a scavenger designated generally by the numeral 96 and including a port 98, best seen in FIG. 2, leading to an elbow 100 which in turn is connected to a pipe 102 leading to an inlet 104 on particle collector 106. This collector is housed above a small fan 108 which draws air through the collector and exhausts through a filter bag 110. The collector and associated parts would normally be mounted on the side of the machine in any convenient position in the general arrangement of FIG. 3.

As seen best in FIG. 2, air drawn from the toner system via the elbow 100 must enter the system through necessary adjustment openings or where toner is delivered. A very low negative pressure (typically flow rate 3 to 5 cu.ft./min. at a negative pressure of 0.5 inches of water) is applied by the fan 108 (FIG. 3) to inspire air through the toner system and to draw the air out via the elbow 100. The port 98 is protected by a small guard plate 112 so that the negative pressure is distributed along the length of the toner system rather than localised where it might inspire toner as well as zinc stearate.

Particles of zinc stearate pass through the pipe 102 and, as seen in FIG. 3, enter the particle collector 106. This collector consists of a series of inclined plates 114, each of which has an opening such as opening 116. However, the openings are staggered so that just as the opening 116 is towards the upper left corner of the associated plate (as drawn), the next opening in the next plate will be in a different location and so on so that the air is made to change direction often thereby throwing particles into portions of low flow or calm. There will consequently be a collection of particles on these plates and in the spaces between plates and eventually the replacable cartridge forming the collector will be discarded and a new one put in position in the holder 118 provided for the purpose.

The bottom of the collector 106 has a large opening 120 for registration with the fan 108 which is attached by screws 122 to the floor 124 of the holder 118. Similarly, the side walls of the holder project below the floor to provide for connecting the filter bag 110 using a peripheral strip 126 and screws 128.

It would be evident that some relatively small particles could get past the collector 106 and of course this is a function of the number of plates, the pressures used, flow rate, etc. However as the plates become coated with particles the aerodynamics will change and some particles could pass through the fan where they will be trapped in bag 110. Consequently to service this structure it is not only necessary to replace the collector 106, and to clean the bag 110 either by simply shaking it mechanically or possibly washing it.

It has been found that the scavenger 96 has a significant effect on improving the cleanliness of machines on which it is used and also to minimise build up of zinc stearate in the toner system itself. A common characteristic of electrostatic equipment using toner is a white coating of zinc stearate powder on the mechanical components of the machine. This coating is all but eliminated using the present invention.

According to a second aspect of the invention, the toner flowing irom the toner system to the cylinder 32 is controlled in terms of the width of the path of flow by a pair of clips 130, 132 shown in FIG. 3. These clips are held in place by simple friction to the metering blade 87 which can be seen extending from opposite sides of the toner system. Because the clips are of magnetic material, they will affect the field created by the feeder 62 (FIG. 2) so that toner will not flow except between the two clips. As seen in FIG. 3, the backs of the clips are shaped with recesses to permit half of a slider 134 to be positioned under the clip for reasons which will be explained.

The clips 130, 132 can be removed totally and are simple to slide on the metering blade for adjustment of the path of toner. Their presence minimises end effects at the ends of the magnetic core 62 and helps to ensure that the portion between the clips receives a constant uniform flow of toner.

A third aspect of the invention is a cleaner for the edge of the metering blade to ensure that any build up occurring there is removed periodically to ensure even distribution of toner and prevent lumping which would affect distribution. As seen in FIG. 2, the slider 134 is mounted on a rod 136 which, as seen in FIG. 3, is attached at its ends by small brackets 138 to the underside of the metering blade 87. At its forward extremity, the slider 134 carries a hardened steel spike 140 which is biased into light contact with the leading edge of the metering blade 87. When the slider moves along the rod 136, the spike rubs against the edge of the metering blade. Evidently, such movement would cause the spike to rub off any deposit of toner existing on the metering blade.

The drive for the slide 134 can be seen in part in FIG. 3 and with reference also to FIGS. 2 and 4. A drive unit 142 is mounted centrally above the toner system and carries a string 144 which is wrapped about a shaft 146 of the drive unit. The string extends parallel to the metering blade 87 exiting through end walls of the structure at openings 148, 150. It then extends downwardly and through guides 152, (one of which is seen) before extending again parallel to the blade 87 and towards the slider 134. One part of the string is wrapped around a pin 154 on the underside of the slider before being attached to a spring 156 having at its other end, the other end of the string. The string has the effect of tensioning the system and the drive is such that the unit 142 can move the slider in one direction and then reverse and move it in the other direction. The connection between the string and the shaft 146 of the unit 142 relies entirely on friction so that if the unit drives the slider into engagement with one of the clips 130, 132, the string will simply slip until the drive unit stops. This permits a timing cycle to be used to drive the slider and spike either simply from one clip 130 to the other clip 132 or vice versa. As long as the unit is driven for more than the necessary time, the slider will move between these two clips and stay there with the string slipping on the shaft 146 until the unit stops.

In use the operator first decides on the width of the toner path required and moves the clips 130,132 as seen in FIG. 3 towards one another until the selected width is obtained. These clips are available below the plate 160 which covers the lower back of the unit and is held in place by a pair of screws 162, one of which is showm. Once this adjustment has been made, the hopper is supplied with toner and the motors 95,97 engergised to start the magnets and shells rotating. In normal use, and in the absence of a demand for more toner, the shell 84 moves clockwise as does the magnetic core 78. The shell 76 moves at a much slower speed while the agitator, which is driven from the same source, remains stationary because it is connected by a one-way drive. When the sensor 74 calls for more toner, the motor 95 is reversed and this moves the shell 76 in an anticlock direction and also drives the agitator 72 to cause toner to fall towards the shell 76. As soon as sufficient toner is available, the motor 95 is again reversed, thereby stopping the agitator, while moving the shell 76 slowly in a clockwise direction. Toner is then supplied as previously described, and while this is going on, toner tends to form a cloud because it is agitated and falling and this tends to separate out the flow enhancer which, because it is non-magnetic, is effected only by air flow. The air flow inspired by the scavenger 106 therefore entraps the zinc stearate and draws it from the system through the tube 102 and into the agitator where it is trapped as described.

While the equipment is in use, the cleaner is cycled periodically on a timer by energising the motor 142 to move the slider 134. This cycling can be done on a staight time basis because any overide is accomodated by the string 144 slipping on the shaft 146.

It will be evident that the structures described enhanced the efficiency of the toner transfer system generally and also improve the cleanliness of the toner system as well as that of the machine to which it is attached. The various aspects of the invention can take different forms within the scope of the invention as described and claimed.

We claim:

1. Apparatus for use with a magnetic toner transfer system, the toner mix including a particulate non-magnetic flow enhancer and the system comprising:

a hopper having a bottom opening;

a screen placed across the opening to support toner in the hopper with the toner bridging the openings in the screen;

an element in contact with an upper surface of the screen;

means operable to drive the element across the upper surface of the screen whereby said toner bridging is disrupted and toner falls through the screen into the toner system until bridging again occurs;

magnetized means located below the screen for attracting and collecting toner for transfer; and a scavenger for coupling to the toner system to apply a small negative pressure to the system whereby air is caused to flow through the falling toner mix and into the scavenger thereby carrying with it the unattracted flow enhancer.

2. Apparatus as claimed in claim 1 in which the screen is deflected by contact with the element to ensure sliding contact between the element and the screen and to enhance the action of breaking down the toner bridging.

3. Apparatus as claimed in claim 2 in which the element is generally cylindrical and is mounted with its longitudinal axis generally horizontal, the element including axially disposed rods which contact the screen and are driven sequentially across the screen as the element rotates about the axis of the element.

4. Apparatus for feeding powder toner to a dielectric surface carrying an electrostatic image to be toned, the apparatus comprising:

a hopper having a bottom opening;

apparatus as claimed in claim 1, the screen being positioned in the hopper at said opening;

a cylindrical applicator positioned adjacent the dielectric surface for receiving toner from the hopper;

a sensor system positioned to sense shortage of toner and to provide a signal indicating such shortage; and means responsive to said signal and coupled to the element drive means to drive the element across the screen to release more toner to the applicator.

5. Apparatus for feeding powder toner to a dielectric surface carrying an electrostatic image to be toned, the system comprising:

a hopper having a bottom opening;

apparatus as claimed in claim 1, the screen being positioned in the hopper opening with the element and operable to release toner from the hopper on demand;

a feeder for receiving toner from the hopper and moving the toner past a selected location;

a sensor positioned at said selected location for sensing reduced toner depth as the toner passes the sensor on the feeder and to create a signal upon sensing this reduced toner depth;

means coupled to the element drive means and responsive to said signal to drive the element across the screen to release more toner; and an applicator located adjacent the dielectric surface and between the feeder and the dielectric surface for carrying toner from the feeder to this surface.

6. A toner system for applying controlled amounts of magnetic powder toner onto the surface of an element carrying an electrostatic image to tone the image, the toner being part of a mix including a particulate non-magnetic flow enhancer and the toner system comprising:

a toner hopper having a bottom outlet;

toner release means coupled to the hopper to contain the toner in the hopper and to release toner on demand;

an enclosure located below the hopper to contain toner released from the hopper;

a cylindrical feeder parallel to the element and comprising a cylindrical magnetized core having alternate magnetic polarities spaced equally about its periphery, and a tubular shell containing the core, the shell and core being mounted in the enclosure for independent rotation about the longitudinal axis of the feeder;

a cylindrical applicator parallel to the feeder and positioned between the feeder and the cylinder and adjacent the cylinder, the applicator including a further cylindrical magnetized core having alternate magnetic polarities spaced equally about its periphery and a further tubular shell containing the core, said further core being mounted for angular adjustment and said further shell for rotation about the longitudinal axis of the applicator;

drive means for rotating the core of the feeder and the shell of the applicator continuously and for driving the toner release means intermittently to cause toner to move from the hopper to the surface of said element under the control of magnetic fields created by the cylindrical feeder and the cylindrical applicator;

control means for sensing the supply of toner and creating said demand at the toner release means and for activating the drive means to the toner release means for a pre-determined period of time on creation of said demand thereby causing said intermittent operation of the toner release means; and a scavenger coupled to the enclosure to apply a small negative pressure to the system whereby air is caused to flow through the system and into the scavenger thereby carrying with it free flow enhancer.

7. A method of removing free non-magnetic flow enhancer mixed with magnetic toner as the toner falls from a hopper having a bottom outlet to the surface of an element having an electrostatic charge to be toned, the method comprising the steps:

supporting the toner in the hopper on a screen inside said opening;

agitating the toner immediately above the screen to break down bridging of toner over openings in the screen when toner is needed so that toner falls through the screen until the toner again bridges the openings in the screen;

collecting the toner falling from the screen in magnetic fields created by a feeder having a cylindrical, rotating and magnetized core and a non-magnetic shell about the core, whereby the toner attaches to the shell and moves around the feeder;

scraping toner from the feeder and directing the toner towards stationary magnetic fields created by an applicator having a cylindrical, stationary and magnetized core and a rotating non-magnetic shell whereby the toner leaving the scraper falls under the magnetic influence of the stationary core and is transported to the cylinder by the movement of the rotating shell;

applying a smalll negative air pressure in the vicinity of said magnetic fields to cause an air flow through the toner to entrap the free non-magnetic flow enhancer; and collecting the air flow to remove the flow enhancer from the air.

8. Apparatus for supplying magnetic toner particles to a moving dielectric surface to convert a latent electrostatic image to a visible image, the apparatus comprising:

a hopper containing a mixture of magnetic toner particles and non-magnetic particulate flow enhancer;

means controlling the flow of the mixture from the hopper;

a transporter coupled to the hopper to receive the mixture as it travels from the hopper, the transporter including a cylindrical toner applicator for attracting and picking up the toner particles magnetically and transporting the particles to the image; and a scavenger coupled to the transporter for applying a small negative air pressure to the transporter whereby free non-magnetic flow enhancer tends to be separated from the travelling mixture by entrapment in the resulting air flow so that the flow enhancer particles are removed from the transporter for collection and disposal.

9. Apparatus for supplying magnetic toner particles to a moving dielectric surface to convert a latent electrostatic image to a visible image, the apparatus comprising:

a hopper containing a mixture of magnetic toner particles and particulate flow enhancer;

means controlling the flow of the mixture from the hopper;

a transporter coupled to the hopper to receive the mixture as it travels from the hopper, the transporter including a cylindrical toner applicator for picking up the toner particles magnetically and transporting the particles to the image;

a metering blade spaced from and parallel to the toner applicator for contolling the thickness of toner carried by the applicator; and a pair of magnetic clips attached to the metering blade, the width between the clips defining the width of toner carried by the toner applicator to the image.

10. Apparatus for supplying magnetic toner particles to a moving dielectric surface to convert a latent electrostatic image to a visible image, the apparatus comprising a hopper containing a mixture of magnetic toner particles and particulate flow enhancer;

means controlling the flow of the mixture from the hopper;

a transporter coupled to the hopper to receive the mixture as it travels from the hopper, the transporter including a cylindrical toner applicator for picking up the toner particles magnetically and transporting the particles to the image;

a metering blade spaced from and parallel to the toner applicator for contolling the thickness of toner carried by the applicator; and a cleaner having means in engaged between the metering blade and the toner applicator and in contact with the metering blade and including drive means to move the contact means along the metering blade periodically to remove possible particulate toner build up on the metering blade.

* * * * *